US008608433B2

(12) United States Patent
Lombard et al.

(10) Patent No.: US 8,608,433 B2
(45) Date of Patent: Dec. 17, 2013

(54) TURBINE HAVING VARIABLE THROAT

(75) Inventors: Alain Lombard, Uxgeney (FR); Denis Tisserant, Thaon les Vosges (FR); Stephane D'Hauenens, Thaon les Vosges (FR)

(73) Assignee: Honeywell International, Inc., Morristown, NJ (US)

( * ) Notice: Subject to any disclaimer, the term of this patent is extended or adjusted under 35 U.S.C. 154(b) by 1854 days.

(21) Appl. No.: 10/546,384

(22) PCT Filed: Feb. 19, 2003

(86) PCT No.: PCT/IB03/00576

§ 371 (c)(1), (2), (4) Date: Sep. 22, 2006

(87) PCT Pub. No.: WO2004/074642

PCT Pub. Date: Sep. 2, 2004

(65) Prior Publication Data

US 2007/0031261 A1 Feb. 8, 2007

(51) Int. Cl.
*F01D 17/00* (2006.01)
*F01D 17/14* (2006.01)

(52) U.S. Cl.
USPC ..... 415/157

(58) Field of Classification Search
USPC ..... 415/35, 126, 157, 167; 416/203
See application file for complete search history.

(56) References Cited

U.S. PATENT DOCUMENTS

| | | | | |
|---|---|---|---|---|
| 3,536,417 | A * | 10/1970 | Merkle et al. | 416/223 R |
| 4,502,837 | A * | 3/1985 | Blair et al. | 415/198.1 |
| 4,543,041 | A * | 9/1985 | French et al. | 416/183 |
| 4,589,822 | A * | 5/1986 | Clausen et al. | 415/174.3 |
| 4,776,168 | A * | 10/1988 | Woollenweber | 60/602 |
| 5,025,629 | A * | 6/1991 | Woollenweber | 60/600 |
| 5,441,383 | A * | 8/1995 | Dale et al. | 415/158 |
| 5,758,500 | A * | 6/1998 | Sumser et al. | 60/602 |
| 5,855,117 | A * | 1/1999 | Sumser et al. | 60/602 |
| 6,220,031 | B1 * | 4/2001 | Daudel et al. | 60/602 |
| 6,443,696 | B1 * | 9/2002 | Erdmann et al. | 415/157 |
| 6,694,733 | B1 * | 2/2004 | Bernardini et al. | 60/602 |
| 6,790,016 | B2 * | 9/2004 | Chiang | 417/423.1 |
| 7,024,855 | B2 * | 4/2006 | Perrin et al. | 60/602 |
| 7,097,432 | B1 * | 8/2006 | Lombard et al. | 417/295 |

FOREIGN PATENT DOCUMENTS

| | | | |
|---|---|---|---|
| DE | 3908285 C1 | * | 6/1990 |
| JP | 56044495 A | * | 4/1981 |

* cited by examiner

*Primary Examiner* — Nathaniel Wiehe
*Assistant Examiner* — Sean J Younger

(57) ABSTRACT

The invention relates to a turbine (1) for a turbocharger, comprising a turbine wheel (2) and a turbine housing (5) forming a passage (6) for guiding a fluid flow to the turbine wheel (2), said passage (6) comprising a variable throat providing a throat area (8) as a smallest cross section of the fluid flow, wherein the variable throat is always defined by a annular member (7) surrounding the turbine wheel (2) and being movable in the axial direction of the turbine wheel (2).

9 Claims, 3 Drawing Sheets

TURBINE HAVING VARIABLE THROAT

The present invention generally relates to a turbine for use in a turbocharger, and in particular a turbine having a variable throat for use in a turbocharger.

A conventional turbine of a turbocharger is disclosed in JP-A-60-006020. The turbine comprises a turbine wheel and a turbine housing forming a passage for guiding a fluid flow to the turbine wheel. Within the passage of the turbine housing, a flap is pivotally arranged so as to adjust a smallest cross section of the fluid flow. The smallest cross section of the fluid flow is also called a throat area. An additional actuator is required for pivoting the flap.

It is the object of the present invention to provide a turbine having an improved efficiency and a simplified construction.

This object is achieved by a turbine having the features of claim 1. The invention is further developed as it is defined in the dependent claims.

According to a first aspect of the present invention, a turbine for a turbocharger comprises a turbine wheel and a turbine housing forming a passage for guiding a fluid flow to the turbine wheel, said passage comprising a variable throat for adjusting a throat area of the fluid flow, wherein the variable throat is a annular member surrounding the turbine wheel and being movable in the axial direction of the turbine wheel.

According to a second aspect of the invention, the turbine wheel comprises turbine blades extending the axial direction of the turbine wheel with different lengths.

Preferably, the turbine wheel comprises a plurality of first turbine blades having a first length associated with a first throat area, and a plurality of second turbine blades having a second length associated with a second throat area, wherein the first length being different from the second length.

Preferably, the first and second turbine blades are alternately arranged in the circumferential direction of the turbine wheel.

Preferably, the turbine further comprises a nozzle disposed within the passage, said nozzle comprising stationary or movable vanes.

Preferably, the annular member is moved in accordance to an operational state of the turbocharger.

Preferably, the throat area increases if a rotational speed of the turbocharger increases.

Other objects and features of the present invention are obvious from the following description of the figures.

Preferred embodiments of the present invention are explained in detail under reference of the figures.

Figure 1:
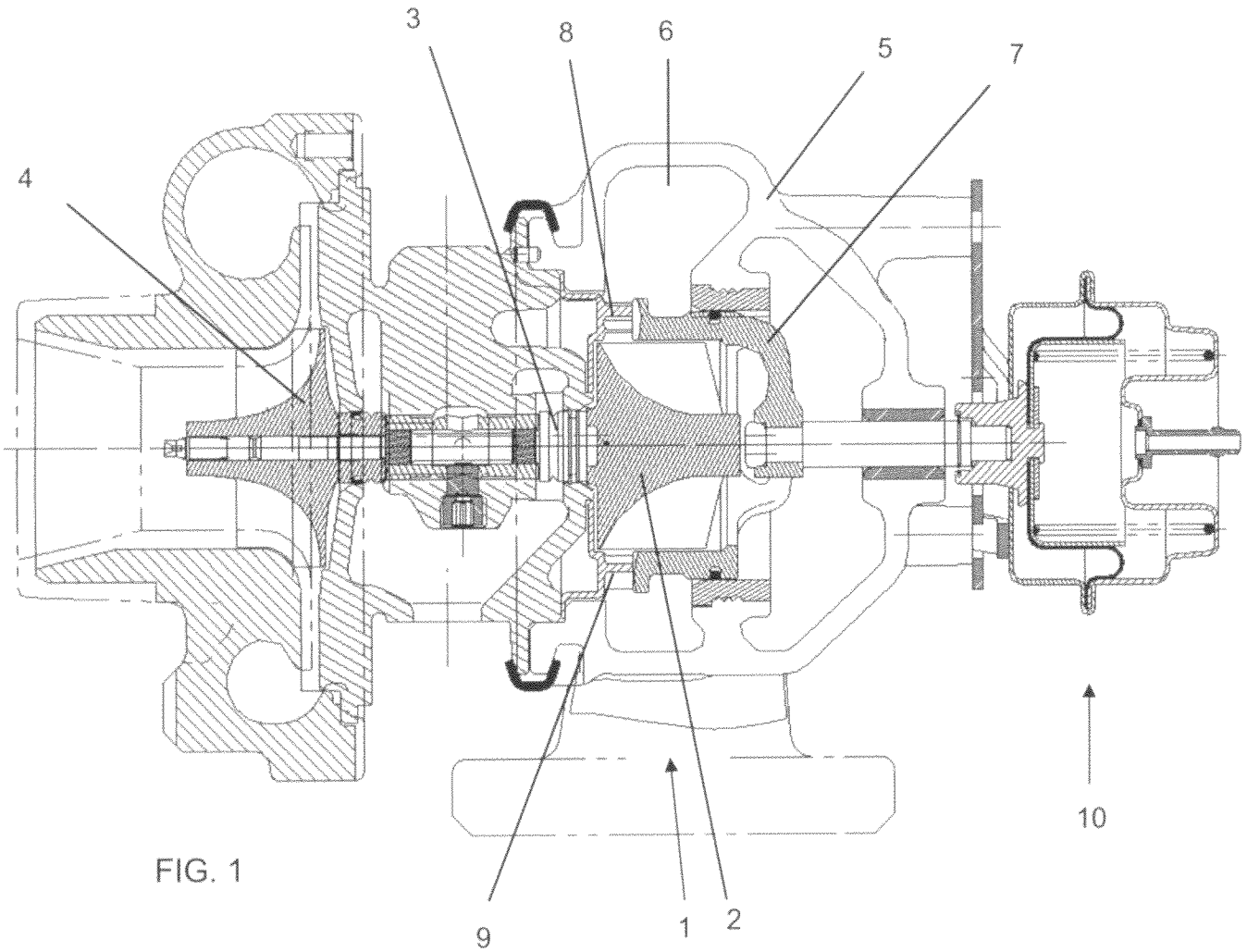
FIG. 1 shows a turbine at high rotational speed according to a first embodiment of the present invention.

A first embodiment of a turbine according to the present invention is described with reference to FIG. 1 and FIG. 2.

A turbine 1 according to the present invention is usually to be incorporated in a turbocharger for a vehicle engine, and the turbine 1 is driven by an exhaust gas emitted from the engine (not shown). Such a turbine 1 is constituted by a turbine wheel 2 mounted at one end of a rotatable shaft 3, while a compressor impeller 4 is mounted at the other end of the rotatable shaft 3. The turbine wheel 2 is accommodated in a turbine housing 5 which forms a passage 6 or a volute for guiding an exhaust gas flow from the engine to the turbine wheel 2.

Within the passage 6, a variable throat provides a smallest cross section of the fluid flow, i.e. a so-called throat area 8. In other words, the variable throat provides a variable "bottleneck" for limiting a maximum exhaust gas flow to pass, from the volute to the turbine wheel 2. In this way, the throat area 8 provides a maximum exhaust gas flow which matches to an operational state of the turbine.

In this embodiment, the variable throat of the turbine according to the invention is always defined by an annular member 7 or a hollow shaft (a hollow piston) surrounding the turbine wheel 2, the annular member 7 being movable in the axial direction of the turbine wheel 2.

Further, in face of the annular member 7, an tubular nozzle is arranged. The nozzle is constituted by an tubular arrangement of vanes 9 for defining a plurality of nozzle passages. In this embodiment, the vanes 9 are stationary, but it is also possible to adopt movable vanes.

The movement of the annular member 7 in the axial direction of the turbine wheel 2 is effected by an actuator 10 which is, preferably, a pneumatic actuator 10. Thereby, the annular member 7 is moved to or from the vanes 9 of the tubular nozzle.

Preferably, the annular member 7 is operated by means for operating the annular member 7 in such a manner that the annular member 7 is moved away from the vanes 9 as an operational rotational speed of the turbine wheel 2 increases, and that the annular member 7 is moved to the vanes 9 as the operational rotational speed of the turbine wheel 2 decreases.

As it is shown in FIG. 1, in high rotational speed ranges, the annular member 7 is positioned far away from the vanes 9 so as to enlarge the throat area 8. Advantageously, the flow capacity is increased such that an engine backpressure in the high rotational speed range of the turbine 1 is reduced.

Figure 2:
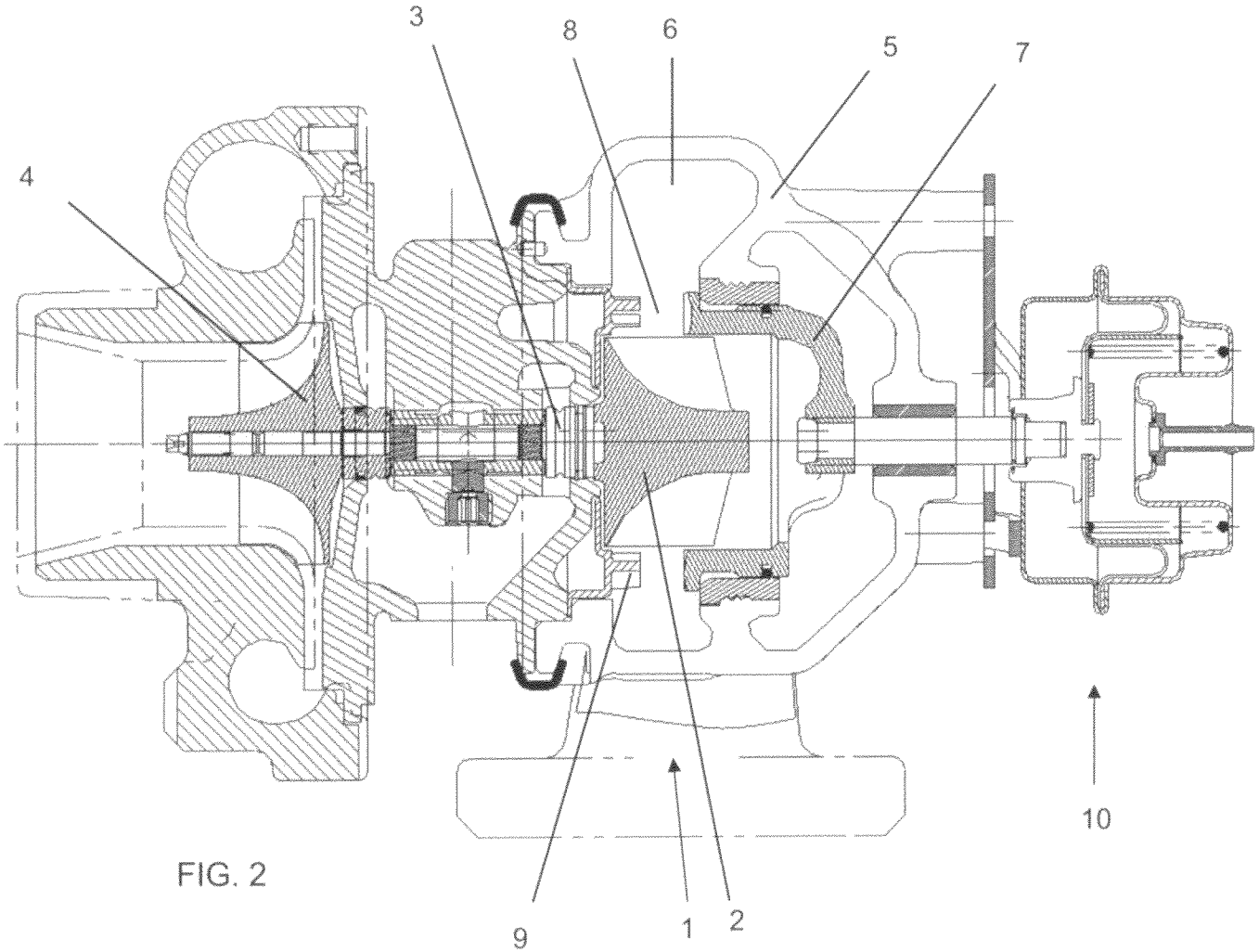
FIG. 2 shows another view of the turbine at low rotational speed according to the first embodiment.

As it is shown in FIG. 2, in a low rotational speed range of the turbine wheel 2, the annular member 7 is positioned closer to the vanes 9 so as to reduce the throat area 8. Thereby, the turbine 1 exhibits a improved efficiency even in the low rotational speed range of the turbocharger.

The first embodiment according to the present invention achieves a large boost in the low rotational speed range due to the reduced throat area 8 when the annular member 7 is in a position closest to the vanes 9.

In high rotational speeds of the engine, the backpressure is reduced due to the enlarged throat area 8 when the annular member 7 is positioned far away from the vanes 9.

Figure 3:
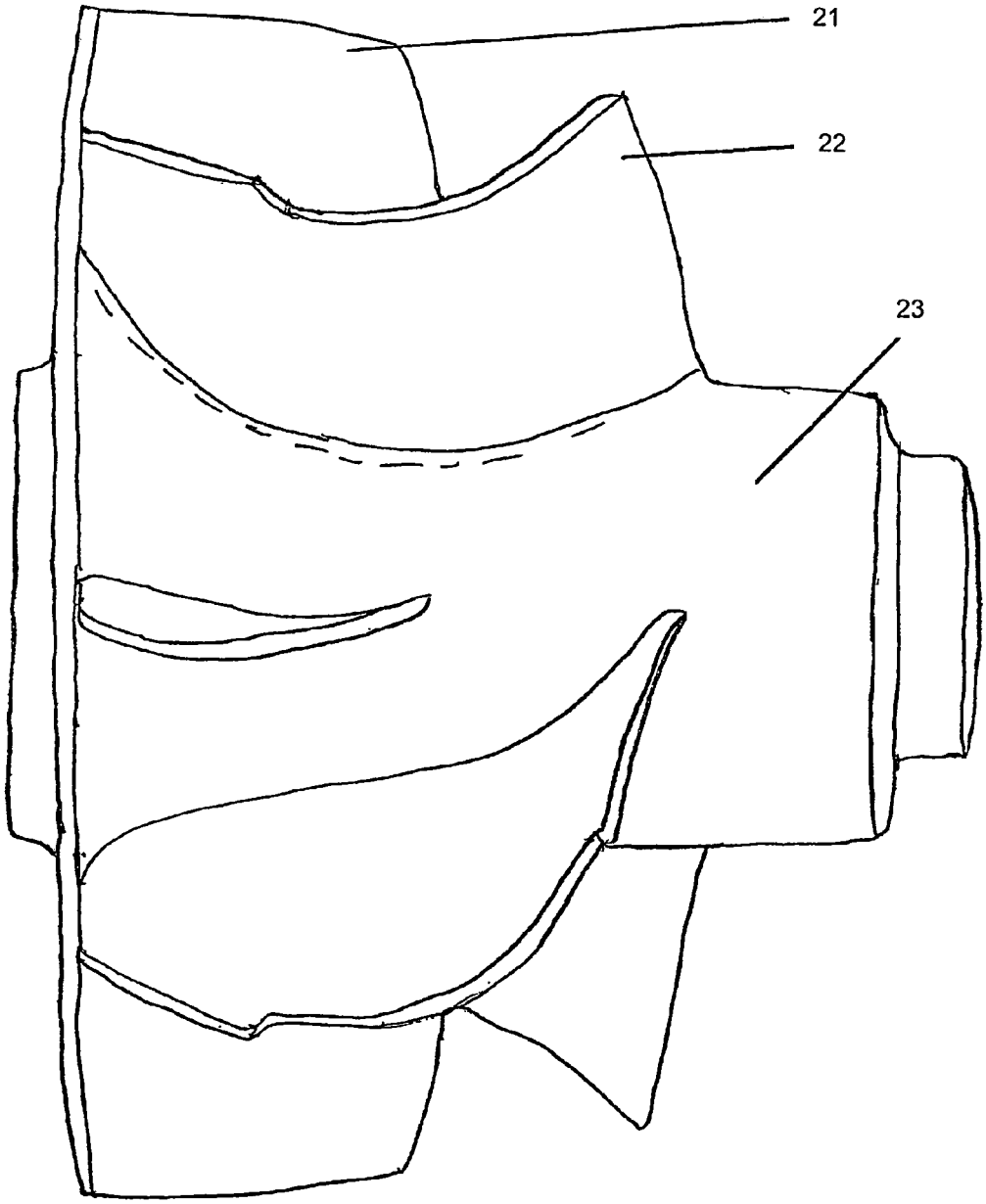
FIG. 3 shows a turbine wheel of a turbocharger according to a second embodiment of the present invention.

A turbine wheel 2A of a turbine 1 according to a second embodiment of the present invention is shown in FIG. 3. The remaining parts are the same as in FIGS. 1 and 2.

The turbine wheel 2A comprises a boss 23, a plurality of first blades 21 and a plurality of second blades 22, wherein the first and second blades 21, 22 are both flush at one lateral side of the boss 23 (the left side according to FIG. 3). The first blades 21 each have a length in the axial direction of the boss 23 which is smaller than the length of the second blades 22 in the axial direction of the boss 23. Furthermore, the first blades 21 are alternately arranged with the second blades 22.

Considering the left side of the turbine wheel 2A according to FIG. 3, the turbine wheel 2A comprises twice as much blades as on the right side of the turbine wheel 2A according to FIG. 3.

The left side of the turbine wheel 2A according to FIG. 3 is optimized with respect to the reduced throat area 8 when the annular member 7 is positioned closer to the vanes 9, while the right side of the turbine wheel 2A according to FIG. 3 is optimized with respect to the enlarged throat area 8 when the annular member 7 is positioned far away from the vanes 9.

This arrangement of the turbine wheel 2A promotes the advantageous effects of the turbine 1 as they are mentioned above.

The embodiments described herein are to be considered as illustrative and they do not limit the scope of protection. The invention can be modified within the scope of the attached claims.

The invention claimed is:

1. A turbine for a turbocharger, comprising:

a turbine wheel having an annular hub, a plurality of first turbine blades and a plurality of second turbine blades;

a turbine housing accommodating the turbine wheel and forming a passage for guiding a fluid flow to the turbine wheel; and an annular member surrounding the turbine wheel and being movable in the axial direction to define a variable throat area through which the fluid flow passes from the passage to the turbine wheel;

wherein the plurality of first turbine blades each has a first length extending axially across the throat area, the plurality of second turbine blades each has a second length extending axially across the throat area, and the first length is shorter than the second length; and wherein the annular member in a reduced-throat position forms a reduced throat area having an axial dimension smaller than the first length, and the annular member in an enlarged-throat position forms an enlarged throat area having an axial dimension greater than the first length, but smaller than the second length.

2. The turbine for a turbocharger according to claim 1, wherein the first and second turbine blades are alternately arranged in the circumferential direction of the turbine wheel.

3. The turbine for a turbocharger according to any one of claim 1 or 2, and further comprising variable nozzle vanes disposed within the passage.

4. The turbine for a turbocharger according to any one of claims 1 or 2, and further comprising an actuator, wherein the actuator is configured to move the annular member in accordance with an operational state of the turbocharger.

5. The turbine for a turbocharger according to claim 4, wherein the actuator is configured to increase the throat area when a rotational speed of the turbocharger increases.

6. The turbine for a turbocharger according to any one of claims 1 or 2, and further comprising:

a nozzle including a plurality of vanes disposed within the passage; and an actuator;

wherein the annular member is configured to move between a position close to the vanes and a position distant from the vanes;

wherein the actuator is configured to move the annular member to the position close to the vanes when it is positioned for a smaller throat area; and wherein the actuator is configured to move the annular member to the position distant from the vanes when it is positioned for an enlarged throat area.

7. The turbine for a turbocharger according to claim 6, and further comprising an actuator, wherein:

the actuator is configured to move the annular member away from the position close to the vanes as the rotational speed of the turbine wheel increases; and the actuator is configured to move the annular member toward the position close to the vanes as the rotational speed of the turbine wheel decreases.

8. A turbine for a turbocharger, comprising:

a turbine housing;

a turbine wheel within the housing the turbine wheel defining an axial direction, and the turbine wheel having a plurality of turbine blades, wherein the housing forms a passage guiding fluid flow to an inlet of the turbine wheel;

an annular member surrounding the turbine wheel, the annular member being movable in the axial direction of the turbine wheel to vary an inlet area of the inlet of the turbine wheel; and a nozzle disposed within the passage, the nozzle including a plurality of vanes; wherein:

the annular member moves between a position close to the vanes and a position distant from the vanes.

9. The turbine for a turbocharger according to claim 8, and further comprising an actuator, wherein:

the actuator is configured to move the annular member away from the position close to the vanes as the rotational speed of the turbine wheel increases; and the actuator is configured to move the annular member toward the position close to the vanes as the rotational speed of the turbine wheel decreases.

* * * * *